US007305205B2

(12) United States Patent
Jeong

(10) Patent No.: US 7,305,205 B2
(45) Date of Patent: Dec. 4, 2007

(54) DEVELOPER CARTRIDGE HAVING A MOVABLE COVER AND LIQUID-TYPE IMAGE FORMING APPARATUS

(75) Inventor: Yoo-hung Jeong, Anyang-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 200 days.

(21) Appl. No.: 11/155,625

(22) Filed: Jun. 20, 2005

(65) Prior Publication Data

US 2006/0062601 A1 Mar. 23, 2006

(30) Foreign Application Priority Data

Sep. 23, 2004 (KR) ..... 10-2004-0076240

(51) Int. Cl.
*G03G 15/10* (2006.01)
*G03G 15/04* (2006.01)
*G03G 15/08* (2006.01)

(52) U.S. Cl. ..... 399/238; 399/119; 399/120

(58) Field of Classification Search ..... 222/DIG. 1; 399/113, 119, 120, 238, 258, 260, 262
See application file for complete search history.

(56) References Cited

U.S. PATENT DOCUMENTS

| | | | |
|---|---|---|---|
| 5,828,935 A | 10/1998 | Tatsumi et al. | |
| 6,438,345 B1 | 8/2002 | Ban et al. | |
| 6,526,243 B2 * | 2/2003 | Kim et al. | 399/119 |

FOREIGN PATENT DOCUMENTS

| | | |
|---|---|---|
| JP | 7-49611 | 2/1995 |
| JP | 2002-311696 | 10/2002 |
| JP | 2004-50470 | 2/2004 |
| KR | 2002-0018574 | 3/2002 |

* cited by examiner

*Primary Examiner*—Hoang Ngo
(74) *Attorney, Agent, or Firm*—Roylance, Abrams, Berdo & Goodman, L.L.P.

(57) ABSTRACT

A developer cartridge having a developer cartridge body with a fitting part is coupled to a developer supply path connected to a developing unit. A fitting part shutter unit is detachably mounted to the developer cartridge body and moved by an external force to move between a first position covering the fitting part and a second position expositing the fitting part.

25 Claims, 7 Drawing Sheets

DEVELOPER CARTRIDGE HAVING A MOVABLE COVER AND LIQUID-TYPE IMAGE FORMING APPARATUS

CROSS-REFERENCE TO RELATED APPLICATIONS

This application claims the benefit under 35 U.S.C. § 119 from Korean Patent Application No. 2004-76240, filed on Sep. 29, 2004, the entire content of which is hereby incorporated by reference in its entirety.

BACKGROUND OF THE INVENTION

1. Field of the Invention

The present invention relates to a developer cartridge for supplying liquid developer to a developing unit. The invention also relates to a liquid-type image forming apparatus including the developer cartridge of the invention.

2. Description of the Related Art

In general, image forming apparatuses are classified into dry-type image forming apparatuses using powdered dry developer and liquid-type image forming apparatuses using liquid developer. The dry-type image forming apparatus and the liquid-type image forming apparatus have their respective advantages and disadvantages. However, the liquid-type image forming apparatus can create high-resolution prints with higher contrast, compared to the dry-type image forming apparatus. Particularly, due to the increase in the widespread use of digital cameras, color prints with higher contrast should be produced more frequently. Accordingly the demand for color image forming apparatuses is expected to gradually increase.

The liquid-type image forming apparatus uses a developer cartridge to supply developer to a developing unit where the developer includes a mixture of a liquid carrier and a powdered toner of a predetermined color. Before the developer cartridge is attached to the image forming apparatus, the developer cartridge is previously filled with a developer having a predetermined color density. Accordingly, after the cartridge containing the developer runs out, the used cartridge is generally replaced with a new cartridge. Fitting units are provided for connecting the developer cartridge to the image forming apparatus in such a manner that the developer can be transferred between the developer cartridge and the developing unit. The fitting units enable the convenient replacement of the developer cartridge.

The fitting units may include a first fitting part connected to tubes for conveying and collecting developer connected to the developing unit, and a second fitting part connected to a developer supply opening portion and a developer collection opening portion of the developer cartridge, which are respectively coupled to the first fitting parts.

The first and second fitting parts may be respectively male and female fitting members that are complementarily coupled to each other.

In the structure described above, when the developer cartridge is attached to the image forming apparatus, the second fitting parts of the developer cartridge are coupled with the first fitting parts provided in the image forming apparatus.

However, according to the above-described structure, since the second fitting parts are exposed to the outside when the developer cartridge is attached to and detached from the image forming apparatus, user's hands may graze the second fitting parts. In particular, when the user detaches the developer cartridge from the image forming apparatus, the user's hands may be stained with some of the developer that is present on the second fitting parts.

Also, the second fitting parts exposed to the outside make an offensive appearance and can be stained or contaminated with dust, etc. during cartridge replacement.

SUMMARY OF THE INVENTION

The present invention provides a developer cartridge with an enhanced structure for covering fitting parts of the developer cartridge to prevent the fitting units from being exposed when not in use. The invention also provides an image forming apparatus with the developer cartridge of the invention.

According to an aspect of the present invention, a developer cartridge is provided comprising a developer cartridge body including a fitting part complementarily coupled to a developer supply path that is connected to a developing unit; and a fitting part shutter unit detachably attached to the developer cartridge body where the shutter unit is movable by an external force to move between a first position covering the fitting part and a second position exposing the fitting part.

The fitting part shutter unit comprises: a shutter member, slidably attached to the developer cartridge body where the shutter unit has a hole which can be aligned with the fitting part according to the position of the shutter member to expose the fitting part; and an elastic member biasing the shutter member in a predetermined direction so that the hole does not align with the fitting unit.

The fitting part shutter unit further comprises: a sliding member slidably attached to the developer cartridge body and supporting a first end of the shutter member; and a holder slidably attached to the developer cartridge body and supporting the other end of the shutter member.

Also, one end of the elastic member is coupled with the holder and the other end of the elastic member is coupled to the developer cartridge body.

An operation rib for moving the sliding member is protruded on the sliding member.

The shutter member is a film formed of a flexible material.

The fitting part shutter unit further comprises; at least one guide roller rotatably attached to the developer cartridge body and positioned for guiding movement of the shutter member.

The fitting part is provided on one side-wall of the developer cartridge body with respect to a longitudinal direction of the developer cartridge body and where the at least one guide roller is placed at each corner of the side-wall.

The developer cartridge further comprises a cover member for covering and supporting the fitting part shutter unit.

The cover member is hooked to the external surface of the developer cartridge body.

The cover member has a hole having a dimension corresponding to the dimension of the fitting part and a guide slit for guiding the movement of the shutter member.

The developer cartridge further comprises a developer gathering unit provided near the fitting part for gathering and collecting drops of the developer that fall from the fitting part.

The developer collecting unit comprises: a developer collecting groove provided near the fitting part and formed with a predetermined depth from an external side-wall of the developer cartridge body; and an absorptive substance provided in the developer collecting groove.

According to another aspect of the present invention, a liquid-type image forming apparatus is provided comprising: an image forming apparatus main body, in which a developing unit is installed, having a cartridge mounting portion; a first fitting part provided in the cartridge mounting portion for coupling to the developing unit; a second fitting part coupled to the first fitting part when a developer cartridge body is installed in the cartridge mounting portion; the developer cartridge body having the second fitting part; and a fitting part shutter unit detachably connected to the developer cartridge body and covering or exposing the second fitting unit according to the position of the fitting part shutter unit, wherein the fitting part shutter unit moves while attaching and detaching the developer cartridge body to and from the cartridge mounting portion.

The fitting part shutter unit comprises: a shutter member, slidably attached to the developer cartridge body, and movable by a predetermined distance when the developer cartridge body is installed in the cartridge mounting portion, thereby moving the shutter member to a second open position to expose the second fitting part; and an elastic member elastically pressing the shutter member to an initial position of the shutter member.

The fitting part shutter unit further comprises: a sliding member slidably attached to the developer cartridge body and supporting a first end of the shutter member; and a holder slidably attached to the developer cartridge body and supporting a second end of the shutter member, wherein the sliding member has an operation rib protruding to the outside so that the sliding member operates in relation to the movement of the developer cartridge body to the cartridge mounting portion.

Preferably, one end of the elastic member is coupled with the holder and the other end of the elastic member is coupled to the developer cartridge body.

The cartridge mounting portion has a guide projection by which the operation rib is captured when the developer cartridge body is installed in the developer container.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Hereinafter, a liquid-type image forming apparatus according to an embodiment of the present invention will be described in detail with reference to the appended drawings.

Figure 1:
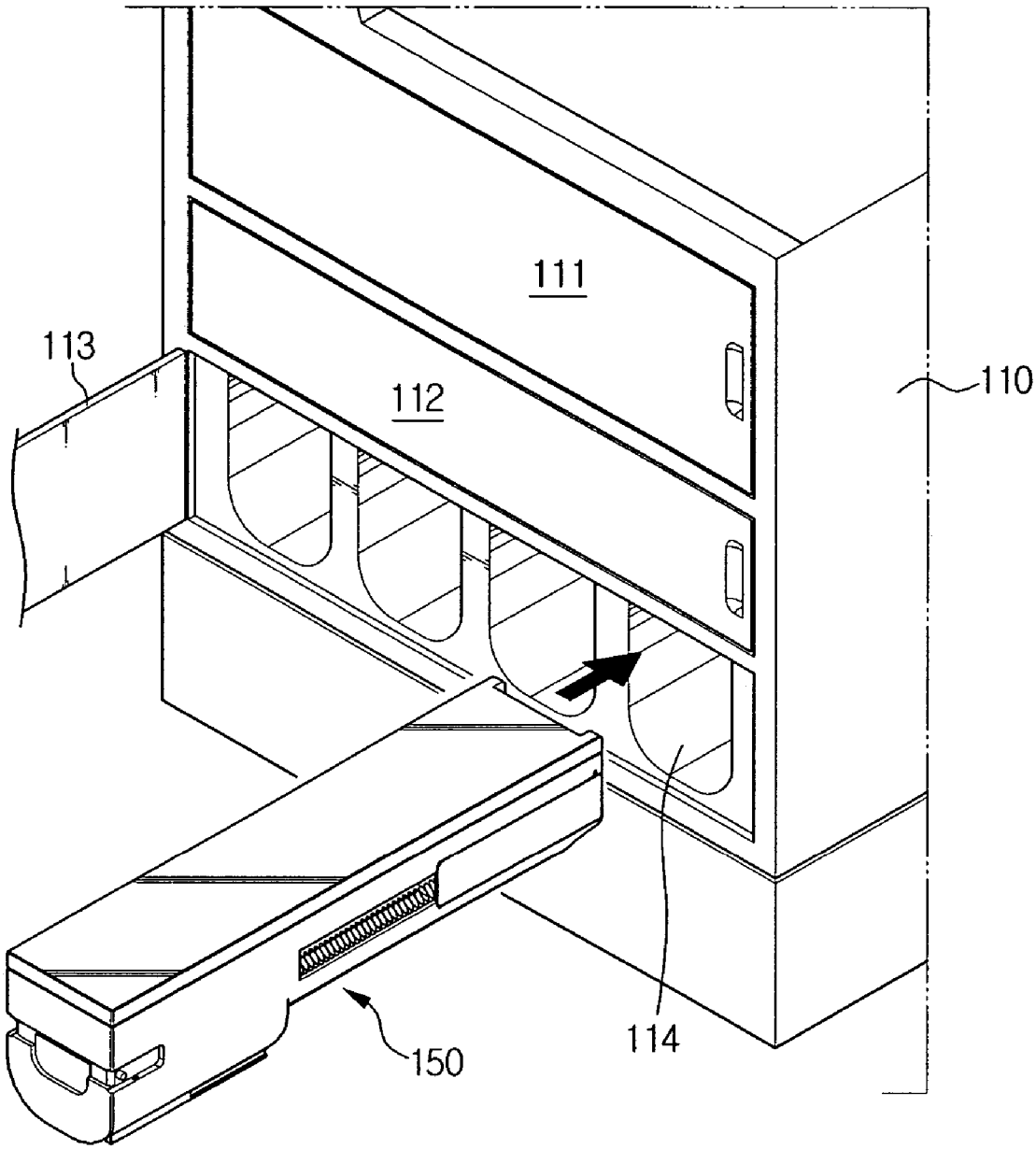
FIG. 1 is a partial exploded perspective view schematically showing a liquid-type image forming apparatus according to an embodiment of the present invention.
Figure 2:
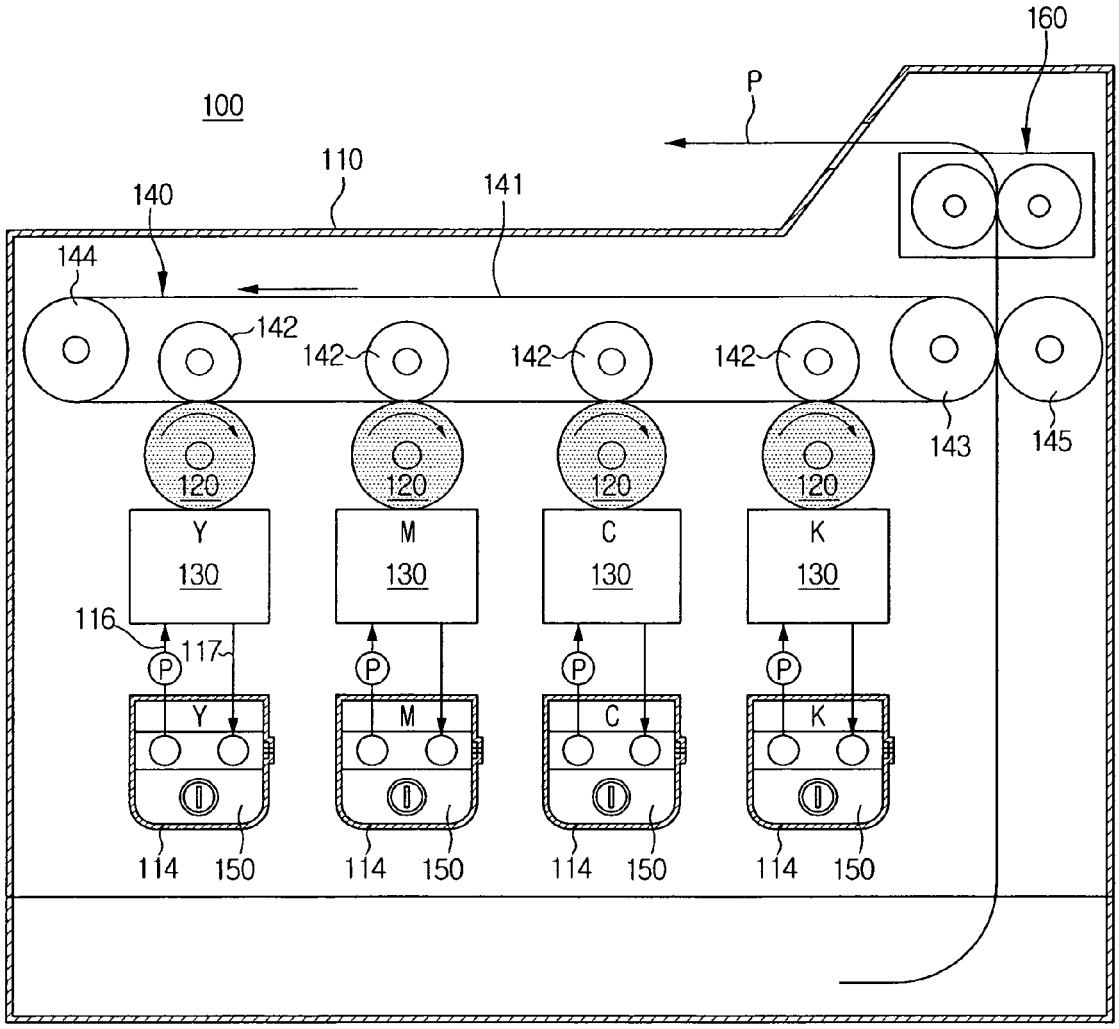
FIG. 2 is a schematic side view showing the configuration of the liquid-type image forming apparatus according to an embodiment of the present invention.

Referring to FIGS. 1 and 2, a liquid-type image forming apparatus 100 for forming color images, according to an embodiment of the present invention, includes an image forming apparatus main body 110, a plurality of developing units 130 for supplying developer to a plurality of image carriers 120 to form images, a transfer unit 140 to which images from the image carriers 120 are transferred, and a plurality of developer cartridges 150 for supplying developer to the respective developing units 130.

The main body 110 includes doors 111 and 112 used for replacing and repairing the image carriers 120, the developing units 130, the transfer unit 140, etc. Also, the main body 110 can further include a cartridge door 113 used for replacing the cartridge 150 with new one.

The image carriers 120 are provided to correspond to each of the colors of yellow (Y), magenta (M), cyan (C) and black (K), in order to form images of the respective colors.

The plurality of developing units 130 are also provided to correspond to the respective image carriers 120. The developing units 130 are positioned above the developer cartridges 150 and receive developer from the respective developer cartridges 150. The developing units 130 transfer the developer supplied from the respective developer cartridge 150 to corresponding image carriers 120 to form images of respective colors.

The transfer unit 140 includes an intermediate transfer belt 141, a plurality of T1 rollers 142, and a T2 roller 145. The intermediate transfer belt 141 is supported by a drive roller 143 and a support roller 144, and overlappingly receives color images formed on the respective image carriers 120 while tracking on an endless track. The color images transferred to the intermediate transfer belt 141 are transferred to a print medium P passing through a space between the intermediate transfer belt 141 and the T2 roller 145.

The print medium P receiving the color images is fixed under high temperature and high pressure while passing through a fixing unit 160 shown in FIG. 2, and then discharged outside the image forming apparatus main body 110.

The image forming apparatus main body 110 includes a plurality of cartridge mounting portions 114 corresponding to respective colors, in which the developer cartridges 150 are installed. The cartridge mounting portions 114 are located below the developing units 130. The cartridge mounting portions 114 can be opened or closed by the cartridge door 113 shown in FIG. 1.

Figure 3:
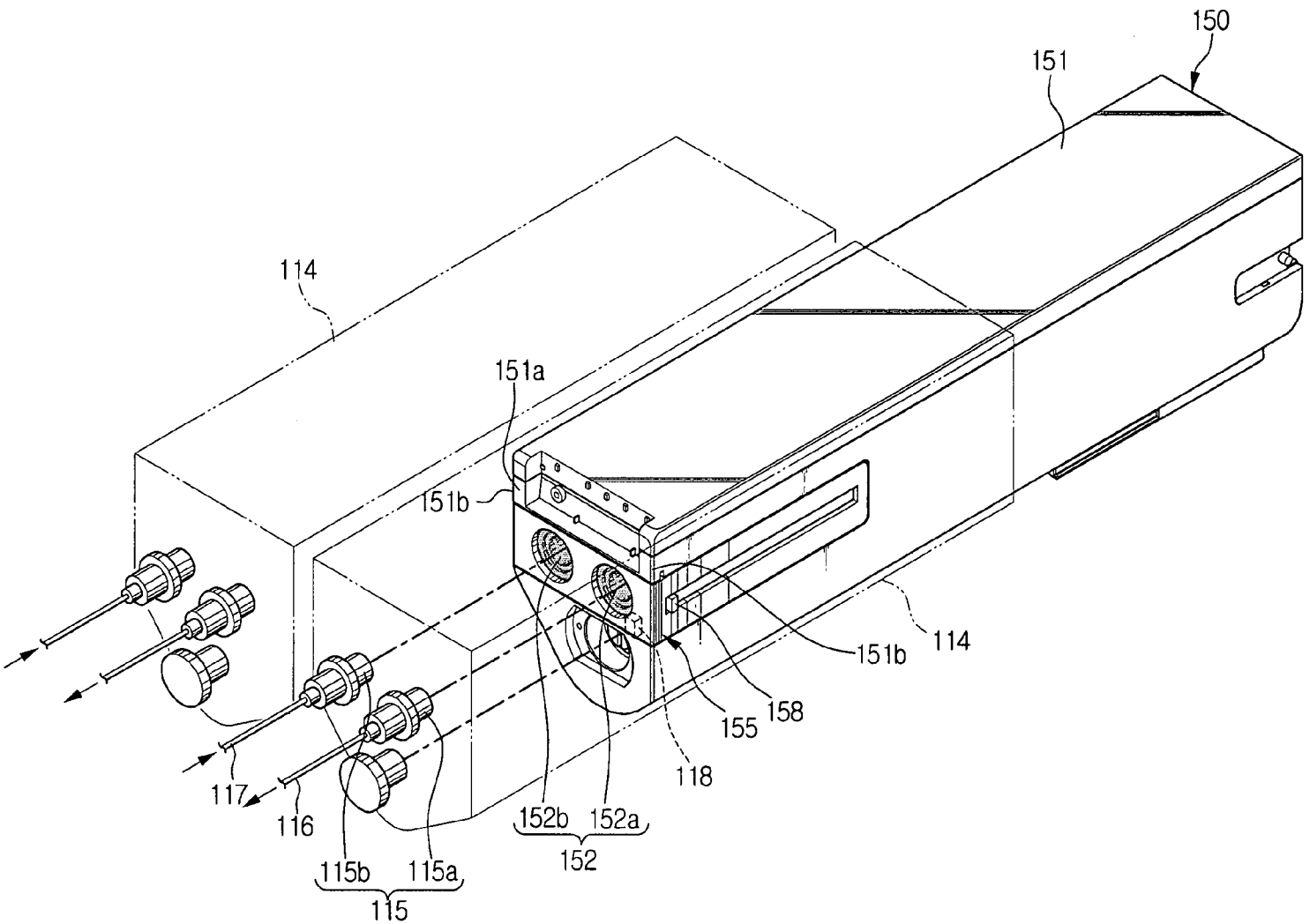
FIG. 3 is a right side perspective view of a developer cartridge shown in FIG. 1.

Referring to FIG. 3, each cartridge mounting portion 114 includes a first fitting part 115. The first fitting part 115 is located inside the cartridge mounting portion 114. The first fitting part 115 includes a first supply fitting member 115*a* used for supplying developer to a developing unit 130 and a first collecting fitting member 115*b* used for collecting residual developer from the developing unit 130 and returning the recovered developer to the developer cartridge 150. The first supply fitting member 115*a* is connected to the developing unit 130 through a supply path 116 with a pump P as shown in FIG. 2. The first collecting fitting member 115*b* is connected to the developing unit 130 through a collecting path 117.

Figure 4:
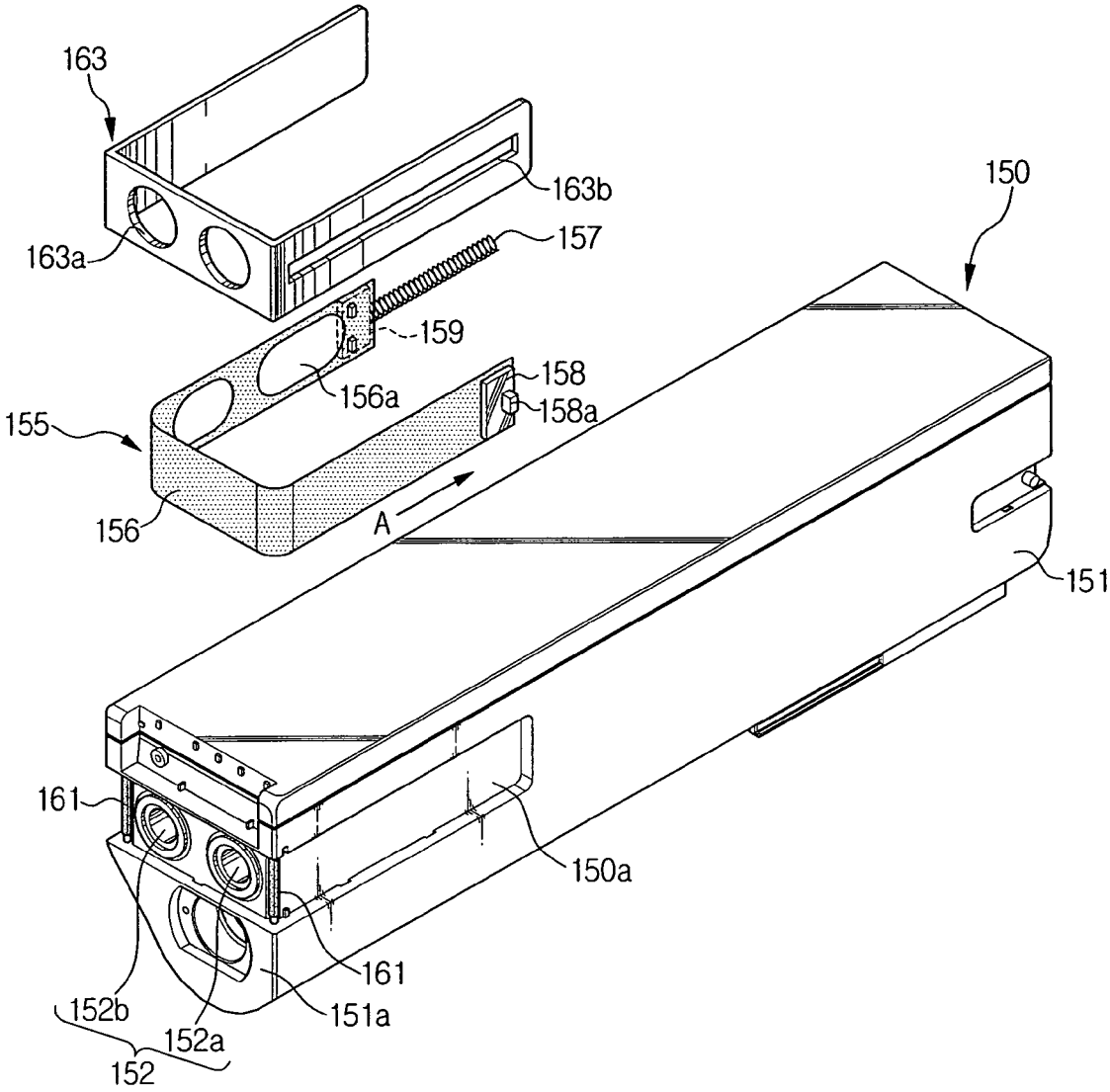
FIG. 4 is an exploded perspective view of the developer cartridge shown in FIG. 3.

The developer cartridge 150, as shown in FIG. 4, includes a cartridge main body 151 and a fitting part shutter unit 155.

The cartridge main body 151 can be detachably and slidably inserted into the cartridge mounting portion 114 and stores developer of each color. The cartridge main body 151 includes a second fitting part 152 corresponding to and complementing the first fitting part 115. The second fitting part 152 includes a second supply fitting member 152*a* corresponding to and complementing the first supply fitting member 115*a*, and a second collecting fitting member 152*b* corresponding to the first collecting fitting member 115*b*.

Figure 5:
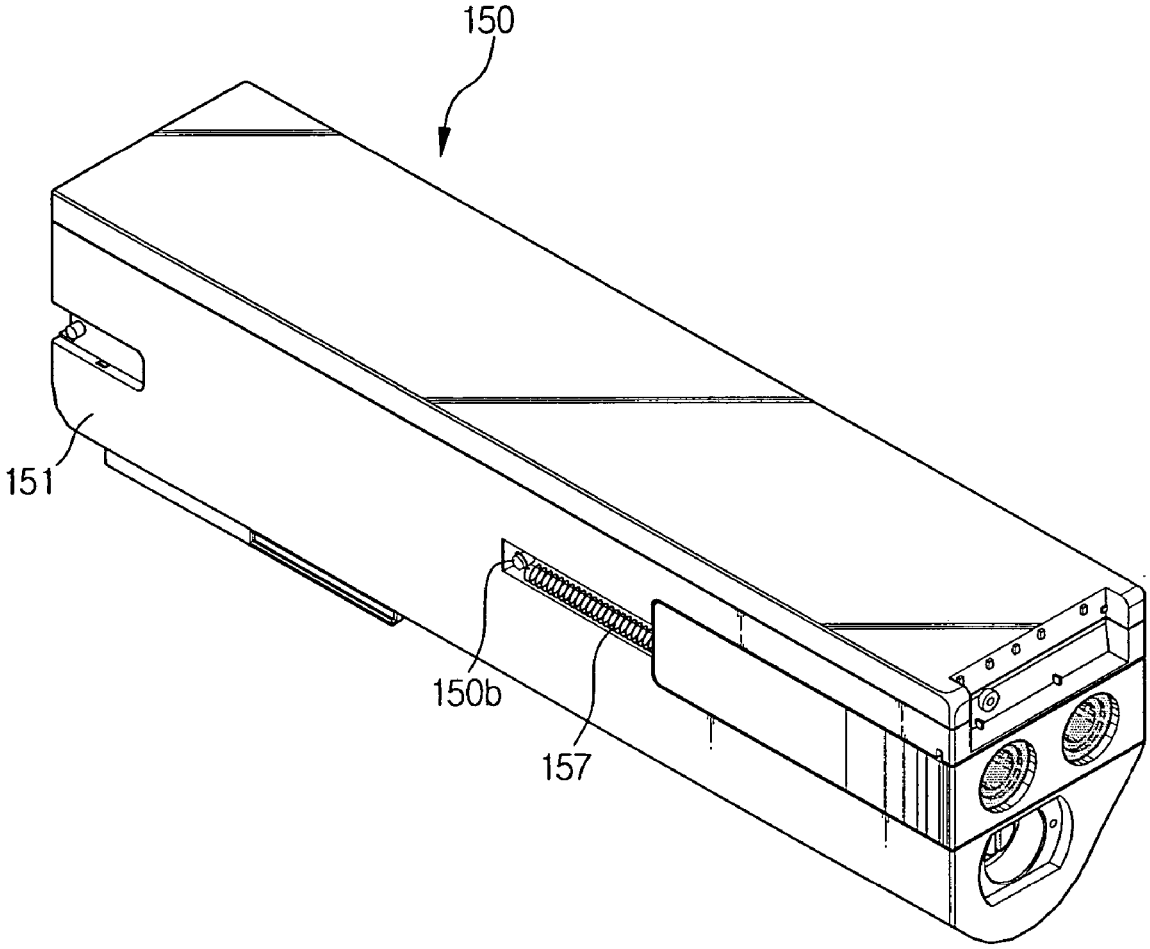
FIG. 5 is a left side perspective view of the developer cartridge shown in FIG. 1.
Figure 6:
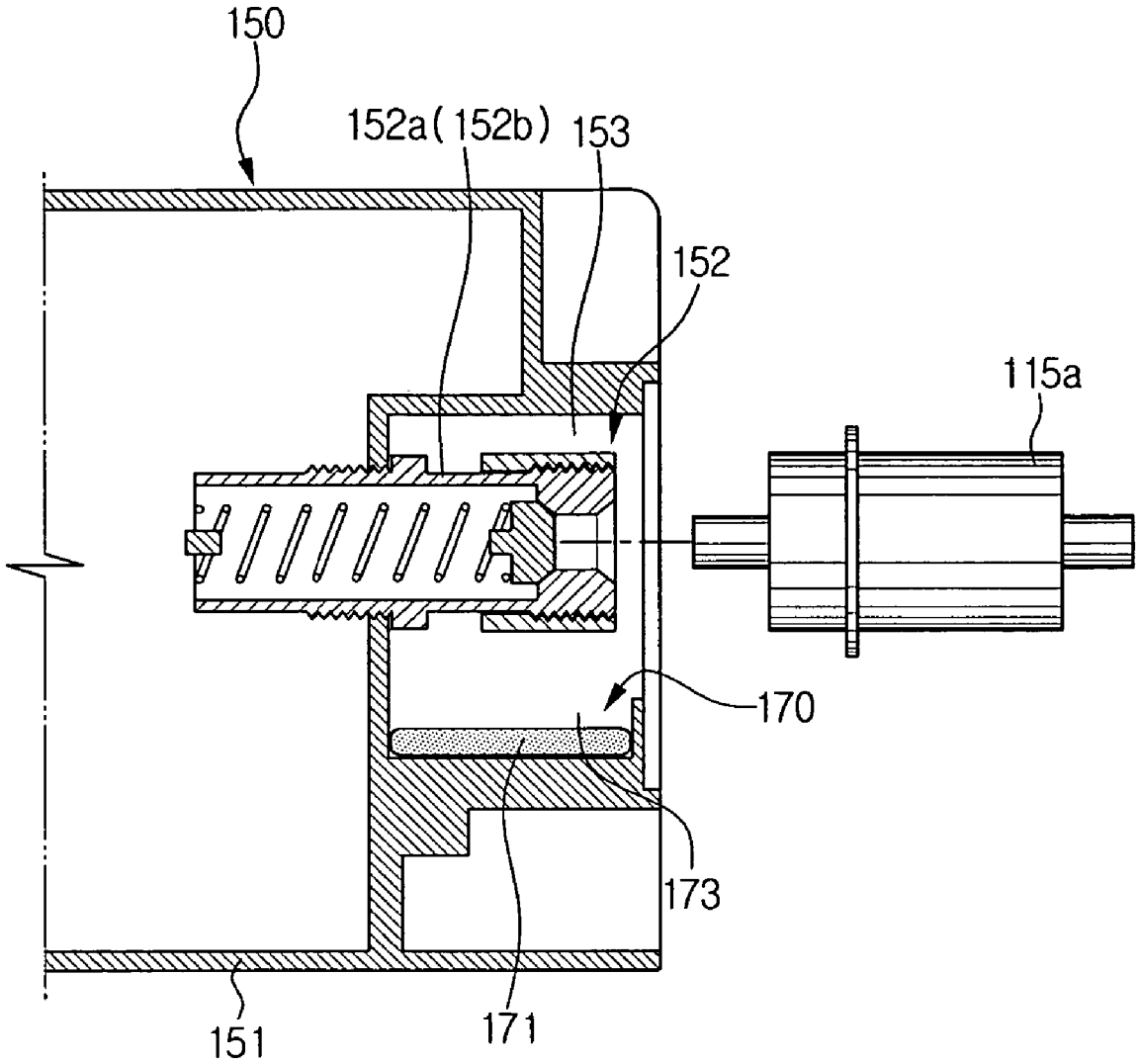
FIG. 6 is an enlarged cross-sectional view of a main portion of the developer cartridge shown in FIG. 5.

Referring to FIGS. 4, 5, and 6, a pair of recesses 153 into which the second fitting members 152*a* and 152*b* are inserted are formed with a predetermined depth in a side-wall 151*a* of the cartridge main body 151. The second fitting members 152*a* and 152*b* are coupled inside the grooves 153 to housing 150 by threaded couplings, as shown in FIG. 6. Here, detailed configurations of the first and second fitting parts 115 and 152 are not included in the present invention, and therefore, a detailed description thereof is omitted. The first and second fitting parts 115 and 152 are fitted to each other, thus allowing the flow of the developer, when the developer cartridge 150 is inserted into the cartridge mounting portion 114. When the developer cartridge 150 is pulled out from the cartridge mounting portion 114, the first and second fitting parts are separated from each other in a closed state.

The fitting part shutter unit 155 is provided to selectively cover or expose the second fitting part 152. The fitting part shutter unit 155 is moved by an external force generated when the cartridge 150 is inserted into or pulled out from the cartridge mounting portion 114. As shown in FIG. 4, the fitting part shutter unit 155 includes a shutter member 156, an elastic spring member 157, a sliding unit 158, a holder 159, and guide rollers 161. Guide rollers 161 are rotatably coupled to cartridge body 151 on each side of second fitting part 152 as shown in FIG. 4.

The shutter member 156 is slidably attached to the outside surface of the cartridge main body 151. The shutter member 156 has a hole 156*a* capable of aligning with and opening the second fitting part 152 according to the position of the shutter member 156 with respect to cartridge body 151. The shutter member 156 has both corners 151*b* between which the side-wall 151*a* of the cartridge main body 151 is placed, and is attached to the cartridge main body 151 so as to cover a portion of the external surface of the cartridge main body 151. The shutter member 156 is preferably a flexible plastic film or a metal film that can wrap around cartridge main body 151 and slide over guide rollers 161 between a first position and a second position where hole 156*a* is aligned with fitting unit 152 to allow a coupling with fitting unit 115 as shown in FIG. 6.

Guide rollers 161 are respectively rotatably positioned at the both corners 151*b* of cartridge main body 151 to assist in a guiding movement of the shutter member 156 along front side 151 of cartridge main body 151.

One end of the shutter member 156 is connected to the sliding member 158 and the other end of the shutter member 156 is connected to the holder 159. The sliding member 158 and the holder 159 are slidably coupled to a guide groove 150*a* formed in the external surface of the cartridge main body 151. The sliding member 158 and the holder 159 are on opposite ends of the shutter member 156 and move together with the shutter member 156.

One end of the elastic spring member 157 is coupled to the holder 159. The other end of the elastic member 157 is coupled to a projection 150*b* formed on the external surface of the cartridge main body 151. The elastic spring member 157 provides a tensile force to the holder 159 by pulling the holder 159, so that the hole 156*a* of the shutter member 156 moves away from and out of alignment with the second fitting part 152.

An operation rib 158*a* protrudes from the outer surface of the sliding member 158. If a force is applied to the operation rib 158*a* in the direction indicated by arrow A, the sliding member 158 slides in the direction of arrow A, thus moving the shutter member 156. The hole 156*a* of the shutter member 156 moves to a location corresponding to and aligning with the second fitting part 152, so that the second fitting part 152 is exposed and accessible by the member 115. The elastic member 157 is extended by the movement of the shutter member 156, thus providing a tensile force to the holder 159. Accordingly, releasing the force applied in the direction of arrow A to the operation rib 158*a*, the shutter member 156 is returned to its initial position by the tensile force of the elastic member 157, thereby again covering the second fitting unit 152.

In one preferred embodiment, a cover member 163 is provided for protecting and covering the fitting part shutter unit 155. The cover member 163 can be hooked onto the guide groove 150*a* of the cartridge main body 151. Accordingly, the cover member 163 is coupled to the guide groove 150*a* in a 'one-touch' manner. The cover member 163 has holes 163*a* corresponding to and aligned with the second fitting part 152 and a guide slit 163*b* for guiding the movement of the sliding member 158. The operation rib 158*a* of the sliding member 158 protrudes through the guide slit 163*b* in cover member 163 as shown in FIGS. 3 and 4.

Referring to FIG. 3, a guide projection 118 for operating the fitting part shutter unit 155 as described above, is formed on the inner sides of the cartridge mounting portion 114. The guide projection 118 can be located in the path of movement of the operation rib 158. The guide projection 118 can be integrally formed with the cartridge mounting portion 114 or formed on a separate bracket.

Preferably, the developer cartridge 150 further includes a developer gathering unit 170 for gathering developer drops flowing from the second fitting unit 152, as shown in FIG. 6. Gathering unit 170 can be, for example, an absorbent member capable of absorbing the liquid toner.

The developer gathering unit 170 includes a collecting groove or recess 173 which is formed with a predetermined depth in the bottom of each recess 153 for the second fitting members 152*a* and 152*b*. Recess 173 is dimensioned to collect the liquid toner that spills or leaks from fitting members 152*a* and 152*b*. An absorptive substance 171 is provided on the bottom of the collecting groove 173. Developer drops formed on the second fitting members 152*a* and 152*b* fall into the collecting groove 173 where developer drops are absorbed and stored into the absorptive substance 171. Accordingly, it is possible to minimize contaminations caused by developer drops generated when the fitting members 152*a* and 115*a* are coupled to or separated from each other. In one embodiment, the absorptive substance 171 is a sponge or other absorbent material.

A method in which a developer cartridge is attached to and detached from an image forming apparatus, according to an embodiment of the present invention, is described below.

As shown in FIG. 1, if a developer of a predetermined color is depleted, a new developer cartridge 150 is inserted and installed in a corresponding cartridge mounting portion 114.

Figure 7:
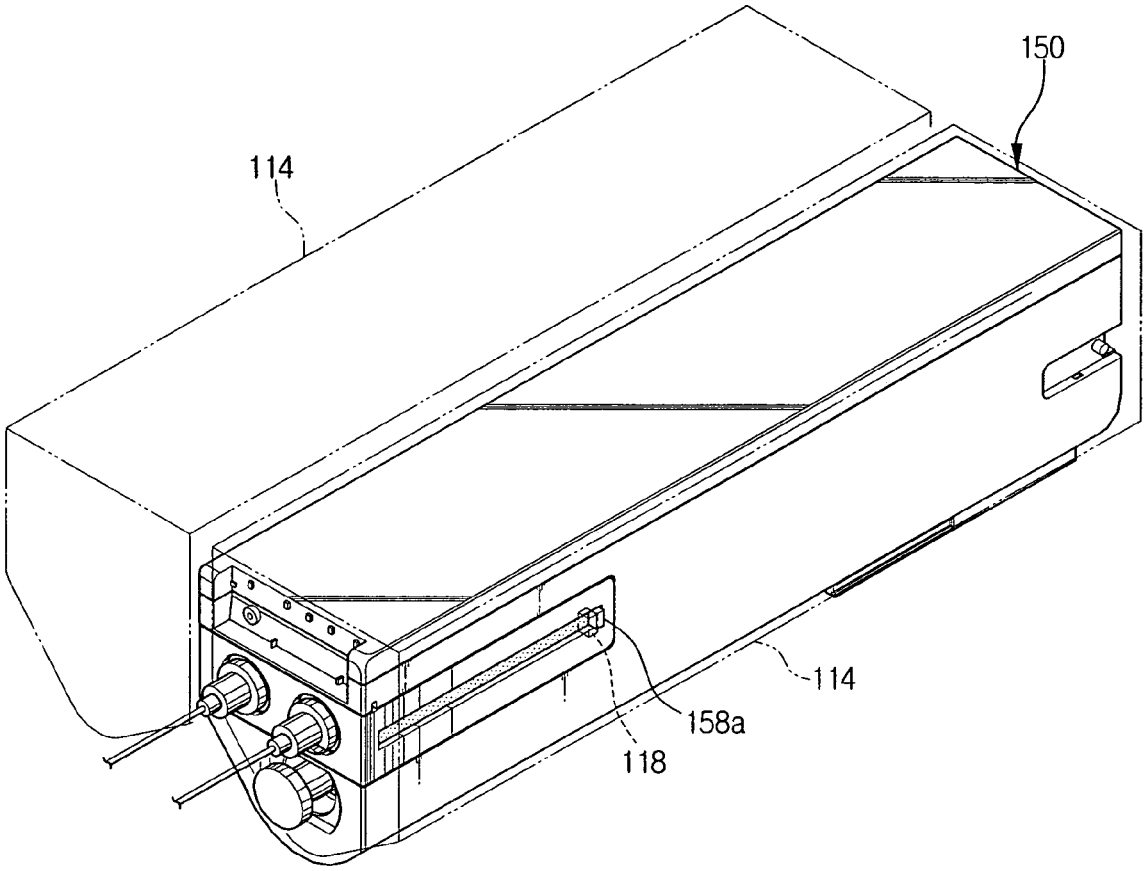
FIG. 7 is a perspective view showing the developer cartridge installed in a cartridge mounting portion, according to an embodiment of the present invention.

As shown in FIG. 3, the second fitting part 152 is covered with the shutter member 156 before the developer cartridge 150 is inserted into the cartridge mounting portion 114. When the operation rib 158*a* of the sliding member 158 is caught by the guide projection 118 mounted on the cartridge mounting portion 114, the shutter member 156 is moved and retracted by a force generated when the developer cartridge 150 is inserted into the cartridge mounting portion. As shown in FIG. 7, the hole 156*a* of the shutter member 156 moves to align with the second fitting part 152. Once the hole 156*a* of shutter member 156 is aligned with the second fitting part 152, the second fitting part 152 can be coupled to the first fitting part 115. When the developer cartridge 150 is completely inserted into the cartridge mounting portion 114, the shutter member 156 is maintained in an open position.

If the developer cartridge 150 is again pulled out from the cartridge mounting portion 150, the shutter member 156 is returned to its initial location by the tensile force of the elastic member 157, thereby covering the first fitting part 115 and the detached second fitting part 152. Accordingly, it is possible to prevent contamination of the second fitting part 152 of the developer cartridge 150 and cover up any bad appearance.

As described above, according to a developer cartridge and a liquid-type image forming apparatus of the present invention, it is possible to selectively cover the fitting parts of a developer cartridge. By providing a structure capable of exposing the fitting parts when the developer cartridge is attached to the image forming apparatus and covering the fitting parts when the developer cartridge is detached from the image forming apparatus, it is possible to prevent contamination of the fitting parts of the cartridge.

Also, since the fitting parts of the developer cartridge are covered, a pleasant exterior can be maintained.

Also, by providing a structure capable of gathering and storing developer drops falling from the fitting parts of the developer cartridge, it is possible to prevent contamination caused by the developer drops falling from the fitting parts.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A developer cartridge comprising:

a developer cartridge body including a fitting part coupled to a complementing developer supply path connected to a developing unit;

a fitting part shutter unit detachably mounted to the developer cartridge body and being movable by an external force to move between a first position covering the fitting part and a second position exposing the fitting part; and a cover member overlying the fitting part shutter unit.

2. The developer cartridge of claim 1, wherein the fitting part shutter unit comprises:

a shutter member slidably mounted on the developer cartridge body and having a hole which can be aligned with the fitting part according to the position of the shutter member to expose the fitting part; and an elastic member biasing the shutter member in a predetermined direction so that the hole does not align with the fitting part.

3. The developer cartridge of claim 2, wherein the fitting part shutter unit further comprises:

a sliding member slidably attached to the developer cartridge body and supporting a first end of the shutter member; and a holder slidably attached to the developer cartridge body and supporting a second end of the shutter member.

4. The developer cartridge of claim 3, wherein a first end of the elastic member is connected to the holder and a second end of the elastic member is coupled to the developer cartridge body.

5. The developer cartridge of claim 3, wherein said sliding member includes an operation rib for moving the sliding member.

6. The developer cartridge of claim 2, wherein the shutter member is a film formed of a flexible material.

7. The developer cartridge of claim 2, wherein the fitting part shutter unit further comprises;

at least one guide roller rotatably attached to the developer cartridge body and positioned for guiding movement of the shutter member.

8. The developer cartridge of claim 7, wherein the fitting part is positioned on a side-wall of the developer cartridge body with respect to a longitudinal direction of the developer cartridge body and where the at least one guide roller is placed at opposite corners of the side-wall.

9. The developer cartridge of claim 1, wherein the cover member supports the fitting part shutter unit.

10. The developer cartridge of claim 9, wherein the cover member is hooked to an external surface of the developer cartridge body.

11. The developer cartridge of claim 9, wherein the cover member comprises a hole having a dimension corresponding to a dimension of the fitting part and a guide slit for guiding the movement of the shutter member.

12. The developer cartridge of claim 1, further comprising:

a developer collecting unit provided near the fitting part for collecting developer drops falling from the fitting part.

13. The developer cartridge of claim 12, wherein the developer collecting unit comprises:

a developer collecting groove provided near the fitting part and formed with a predetermined depth in an external side-wall of the developer cartridge body; and an absorptive substance provided in the developer collecting groove.

14. A liquid-type image forming apparatus, comprising:

an image forming apparatus main body, in which a developing unit is installed, having a cartridge mounting portion;

a first fitting part provided in the cartridge mounting portion for coupling to the developing unit; and a second fitting part coupled with the first fitting part when a developer cartridge body is installed in the cartridge mounting portion;

said developer cartridge body having the second fitting part; and a fitting part shutter unit detachably mounted to said developer cartridge body and being movable by an external force between a first position covering the second fitting unit and a second position exposing the second fitting unit, wherein the fitting part shutter unit moves in relation to attaching and detaching of the developer cartridge body to and from the cartridge mounting portion, and wherein the fitting part shutter unit includes a flexible shutter member slidably attached to the developer cartridge body and moving a predetermined distance when the developer cartridge body is installed in the cartridge mounting portion, thereby moving the shutter member to the second position to expose the second fitting unit, the flexible shutter member extending from a first side of said developer cartridge body over the second fining part of the developer cartridge body.

15. The liquid-type image forming apparatus of claim 14, further comprising:

an elastic member elastically biasing the shutter member to said first position covering said second fitting unit.

16. The liquid-type image forming apparatus of claim 15, wherein the fitting part shutter unit further comprises:

a sliding member slidably attached to the developer cartridge body and supporting a first end of the shutter member; and a holder slidably attached to the developer cartridge body and supporting a second end of the shutter member, wherein the sliding member has an operation rib protruding to the outside so that the sliding member operates in relation to movement of developer cartridge body to the cartridge mounting portion.

17. The liquid-type image forming apparatus of claim 16, wherein a first end of the elastic member is connected to the holder and a second end of the elastic member is connected to the developer cartridge body.

18. The liquid-type image forming apparatus of claim 16, wherein the cartridge mounting portion has a guide projection by which the operation rib is caught when the developer cartridge body is installed in the developer container to move the shutter member to the second position.

19. The liquid-type image forming apparatus of claim 15, wherein the shutter member is a film formed of a flexible material.

20. The liquid-type image forming apparatus of claim 15, wherein the fitting part shutter unit further comprises:

at least one guide roller rotatably attached to the developer cartridge body for guiding movement of the shutter member.

21. The liquid-type image forming apparatus of claim 14, wherein the developer cartridge further comprises:

a cover member covering and supporting the fitting part shutter unit.

22. The liquid-type image forming apparatus of claim 21, wherein the cover member is hooked to the external surface of the developer cartridge body.

23. The liquid-type image forming apparatus of claim 21, wherein the cover member comprises:

a hole having a dimension corresponding to a dimension of the second fitting part; and a guide slit for guiding movement of the shutter member.

24. The liquid-type image forming apparatus of claim 14, wherein the developer cartridge further comprises:

a developer collecting unit placed near the second fitting part and collecting developer drops flowing from the second fitting part.

25. The liquid-type image forming apparatus of claim 24, wherein the developer collecting unit comprises:

a developer collecting groove placed near the second fitting part and formed with a predetermined depth in an external side-wall of the developer cartridge body; and an absorptive substance provided in the developer collecting groove.

* * * * *